US007750858B2

(12) United States Patent
Nakada

(10) Patent No.: US 7,750,858 B2
(45) Date of Patent: Jul. 6, 2010

(54) DRAWER STRUCTURE OF ROD-SHAPED BODY AND APPARATUS HAVING THE SAME

(75) Inventor: Kazuo Nakada, Sagamihara (JP)

(73) Assignee: Lenovo (Singapore) Pte. Ltd., Singapore (SG)

( * ) Notice: Subject to any disclaimer, the term of this patent is extended or adjusted under 35 U.S.C. 154(b) by 198 days.

(21) Appl. No.: 12/135,140

(22) Filed: Jun. 6, 2008

(65) Prior Publication Data

US 2008/0303741 A1 Dec. 11, 2008

(30) Foreign Application Priority Data

Jun. 6, 2007 (JP) ..... 2007-149935

(51) Int. Cl.
*H01Q 1/24* (2006.01)

(52) U.S. Cl. ..... 343/702; 343/900

(58) Field of Classification Search ..... 343/702, 343/900, 906

See application file for complete search history.

(56) References Cited

U.S. PATENT DOCUMENTS

| | | | | |
|---|---|---|---|---|
| 5,534,878 | A * | 7/1996 | Johnson | 343/702 |
| 5,684,672 | A * | 11/1997 | Karidis et al. | 361/679.26 |
| 6,628,236 | B2 * | 9/2003 | Kim et al. | 343/702 |

FOREIGN PATENT DOCUMENTS

| | | |
|---|---|---|
| JP | S49-129452 | 11/1974 |
| JP | H06-60035 | 3/1994 |
| JP | 2002-344220 | 11/2002 |
| JP | 2003-298324 | 10/2003 |
| JP | 2004-221728 | 8/2004 |
| JP | 2006-129404 | 5/2006 |

* cited by examiner

*Primary Examiner*—Hoang V Nguyen
(74) *Attorney, Agent, or Firm*—Ference & Associates LLC

(57) ABSTRACT

A drawer structure of a rod-shaped body, which does not require a complicated inner structure, is provided. In a present preferred embodiment, a structure draws a rod-shaped body out of a housing for housing the rod-shaped body. A guide for holding the rod-shaped body so that the rod-shaped body can be rotated about an axis and slid in the direction of the axis, and an encasing surface which crosses at a predetermined angle to the axis of the rod-shaped body are formed on the housing side. The rod-shaped body has an internal surface facing to the encasing surface, and a cap is formed at a tip of the rod-shaped body so that the internal surface may be a predetermined angle to the axis of the rod-shaped body. When the rod-shaped body is inserted into the guide and the rod-shaped body is rotated from a state where the encasing surface and the internal surface are contacted with each other, the rod-shaped body performs a translatory movement in an axial direction of the guide according to the cam effect.

18 Claims, 3 Drawing Sheets

DRAWER STRUCTURE OF ROD-SHAPED BODY AND APPARATUS HAVING THE SAME

CLAIM FOR PRIORITY

This application claims priority from Japanese Application No. 2007-149935 filed on Jun. 6, 2007, and which is fully incorporated by reference as if fully set forth herein.

FIELD OF THE INVENTION

The present invention relates generally to a drawer structure of a rod-shaped body which is drawably accommodated in an apparatus.

BACKGROUND OF THE INVENTION

In an electronic device, there is a case where a variety of accessories having a rod shape are accommodated therein. For example, in the past, a rod antenna is accommodated in a portable or mobile radio receiver, and a stylus pen is accommodated in a tablet computer, a PDA, and a game machine for inputting instructions in a touch panel. In recent years, the rod antenna is also provided in a notebook personal computer (hereinafter, simply referred to as "note PC"), the PDA, or a cellular phone. Some stylus pens or rod antennas are accommodated in a housing of an apparatus when they are not in use, and a portion of them is exposed to the surface of the housing. When they are used, a user picks the exposed portion with the user's fingers to extend to a predetermined length or to separate them from the apparatus.

There are known technologies to drawably accommodate a rod-shaped body such as an antenna in a portable or mobile type electronic device. Japanese Laid-open (Kokai) Patent Publication No. 2002-344220 describes an accommodation structure in which a tip of an antenna guide cylinder and an antenna cap are threaded to be fitted to each other, and in which the antenna cap is rotated upon accommodation of an antenna to be fixed to a terminal body. Japanese Laid-open (Kokai) Patent Publication No. 2004-221728 describes an accommodation structure in which an antenna picking portion has a twisted portion, and in which when a user pushes a terminal body, an antenna can be accommodated in a state where the antenna picking portion faces a predetermined direction, i.e., a trademark faces the front side.

The conventional accommodation structure has no problem if there is a sufficient space on the surface of an apparatus housing for housing the rod-shaped body and an exposed portion can be projected by a sufficient length from the surface of the housing. However, particularly, in a portable or mobile electronic device which has a limited space and needs to have good external appearance, it is difficult to form the rod-shaped body to have a large head portion or a large drawn-out portion. When the drawn-out portion is small, the operability may decrease because a large force or time is required to pick out the drawn-out portion. In addition, in a cellular phone, a PDA, or a note PC, a user may want to perform a drawing operation of the rod-shaped body with the user's hand while holding the apparatus body. Therefore, a drawer structure is desired which makes a user easy to draw a rod-shaped body out of a housing while decreasing a required space on the housing surface.

To make it easy to draw out the rod-shaped body, a drawer structure of a rod-shaped body using a spring or a lever may be provided in an apparatus body; alternatively, a concave portion may be provided in a portion of a housing disposed around a tip of a rod-shaped body so that a user easily can pick out the tip. However, the drawer structure using the spring or the lever has limitations in terms of a cost, an internal space of the apparatus, and a weight. Meanwhile, when the concave portion is provided in the housing, a processing cost for forming the concave portion is required and the strength of the housing may decrease, while impairing the external appearance. In addition, when the rod-shaped body is an antenna, and when a metal component is used for the spring or the lever, or a metal component is used to reinforce the strength of the housing decreased by the concave portion, the communication performance may decrease.

Accordingly, a compelling need has been recognized in connection with addressing such challenges.

SUMMARY OF THE INVENTION

In accordance with at least one presently preferred embodiment of the present invention, the principle of the present invention as broadly contemplated herein lies in the use of the cam effect that transforms a rotational movement of a contact portion into a translatory movement of a rod-shaped body by means of the contact portion coupled with a rod-shaped body at an oblique angle to the axis of the rod-shaped body, an encasing surface inclined to the axis, and a guide defining a sliding direction of the rod-shaped body.

In summary, one aspect of the invention provides an apparatus comprising: a drawer structure for drawing a rod-shaped body out of a housing, the rod-shaped body having a large diameter portion at a tip thereof and being provided with an axis extending in a longitudinal direction, the drawer structure comprising: a guide for holding the rod-shaped body so that the rod-shaped body can be rotated about the axis and slid in the direction of the axis, the guide being formed in the housing; an encasing surface which crosses at a first angle to the axis when the rod-shaped body is inserted into the guide, the encasing surface being formed around an insertion slot of the guide; and a contact portion which receives force from the encasing surface when the rod-shaped body rotates about the axis, the contact portion being formed in the large diameter portion and being coupled with the rod-shaped body at a second angle to the axis.

Another aspect of the invention provides an apparatus comprising: a drawer structure for drawing a rod-shaped body having, at a tip thereof, a large diameter portion out of a housing provided with a guide, wherein an encasing surface is formed around an insertion slot of the guide while forming a first angle to a drawing direction of the rod-shaped body; a contact portion is defined to the large diameter portion, the contact portion being coupled with the rod-shaped body at a second angle to the drawing direction, and the contact portion receiving force from the encasing surface when the large diameter portion of the rod-shaped body inserted into the guide is rotated; and a portion of the rod-shaped body further receives force from the guide so that the rod-shaped body slides in the drawing direction.

Furthermore, an additional aspect of the invention provides an apparatus comprising: a housing; a rod-shaped body which has a large diameter portion at a tip thereof, and is provided with an axis extending in a longitudinal direction; a guide for holding the rod-shaped body so that the rod-shaped body can be rotated about the axis and slid in the direction of the axis, the guide being formed in the housing; an encasing surface which crosses at a first angle to the axis when the rod-shaped body is inserted into the guide, the encasing surface being formed around an insertion slot of the guide; and a contact portion which receives force from the encasing surface when the rod-shaped body rotates about the axis, the contact portion being formed in the large diameter portion and being coupled with the rod-shaped body at a second angle to the axis.

For a better understanding of the present invention, together with other and further features and advantages thereof, reference is made to the following description, taken in conjunction with the accompanying drawings, and the scope of the invention will be pointed out in the appended claims.

DETAILED DESCRIPTION OF THE PREFERRED EMBODIMENTS

Figure 1:
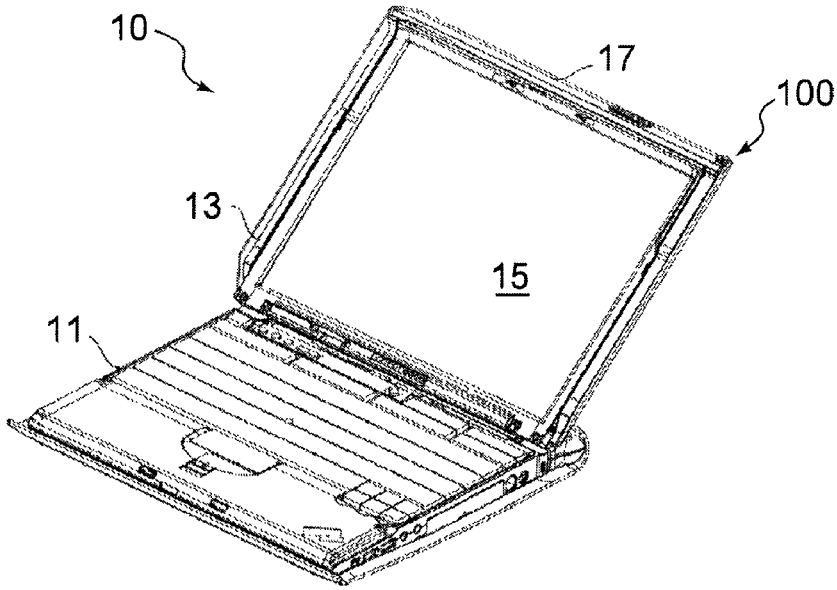
FIG. 1 is a perspective diagram illustrating the external view of a note PC according to an embodiment of the present invention.

For a better understanding of the present invention, together with other and further features and advantages thereof, reference is made to the following description, taken in conjunction with the accompanying drawings, and the scope of the invention will be pointed out in the appended claims.

It will be readily understood that the components of the present invention, as generally described and illustrated in the Figures herein, may be arranged and designed in a wide variety of different configurations. Thus, the following more detailed description of the embodiments of the apparatus, system, and method of the present invention, as represented in FIGS. 1 through 4C, is not intended to limit the scope of the invention, as claimed, but is merely representative of selected embodiments of the invention.

Reference throughout this specification to "one embodiment" or "an embodiment" (or the like) means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

Furthermore, the described features, structures, or characteristics may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals or other labels throughout. The following description is intended only by way of example, and simply illustrates certain selected embodiments of devices, systems, and processes that are consistent with the invention as claimed herein.

In accordance with a first aspect of the present invention, the rod-shaped body has a large diameter portion at a tip thereof and is provided with an axis extending in a longitudinal direction, and is accommodated in a housing. A guide is formed in the housing and holds the rod-shaped body so that the rod-shaped body can be rotated about the axis and slid in the direction of the axis. Since the rod-shaped body inserted into the guide is slid in the direction of the axis, the axis of the rod-shaped body can be referred to as an axis of the guide.

The guide may be formed inside the housing and may be formed into a groove shape in the surface of the housing. In addition, since the guide only needs to allow the rod-shaped body to rotate about the axis and to slide in the direction of the axis, it is not necessary to guide the rod-shaped body along the whole length of the axis but the rod-shaped body may be guided along a partial length of the axis. An encasing surface is formed around an insertion slot of the guide, and the encasing surface crosses at a first angle to the axis of the rod-shaped body in a sate where the rod-shaped body is inserted into the guide. The contact portion is formed in the large diameter portion and is coupled with the rod-shaped body at a second angle to the axis of the rod-shaped body. Since the rod-shaped body at an accommodation position is drawn out from the housing, when the rod-shaped body rotates about the axis, the contact portion receives force from the encasing surface while being slid over the inclined encasing surface.

When the rod-shaped body is positioned at an accommodation position where it is completely accommodation in the housing, the contact portion is disposed at the lowest position of the inclined encasing surface. When the rod-shaped body is rotated in such a state, since the second angle is maintained during rotation, the contact portion receives force from the encasing surface inclined in the ascending direction whereby a rotation moment that rotates the rod-shaped body in a direction vertical to the axis is generated. Since the rod-shaped body is allowed to rotate about the axis but is prohibited by the guide from rotating in a direction vertical to the axis, the rod-shaped body is slid in the direction of the axis. Therefore, it becomes possible to draw the rod-shaped body out of the housing to an extent that a user can easily pick the large diameter portion. In addition, since this drawer structure has a simple construction, the drawer structure can be embodied inside the housing or on the housing surface around the insertion slot without requiring a large space.

When the large diameter portion includes an internal surface facing to the encasing surface, the contact portion may form a portion of the internal surface. In this case, when the encasing surface and the internal surface are constructed as flat surfaces, and the first angle and the second angle are made identical to each other, the internal surface of the large diameter portion makes contact with the encasing surface at the accommodation position where the rod-shaped body is accommodated in the housing. Therefore, it is possible to provide good accommodation properties of the rod-shaped body with respect to the housing and to provide an excellent appearance. The large diameter portion may be constructed to form a portion of the rod-shaped body and may be constructed as a separate component so that it is fixed to the rod-shaped body by means of screw fixing only during use. In addition, the large diameter portion may not be circular but may be elliptical or rectangular.

The first and second angles, theoretically, need to be in the range of 0 degrees to 90 degrees in order to exhibit the cam effect; however, practically, they may be selected in the range of 40 degrees to 80 degrees. When the angles are selected from the range of 40 degrees to 80 degrees, the rod-shaped body can be slid by a rotation of about ½ rotation to an extent that the large diameter portion can be picked out by the user's fingers. Moreover, the force required to rotate the large diameter portion can be decreased to a range where the large diameter portion can be rotated by the human's fingers.

Although the second angle only needs to be secured at a time the rod-shaped body is drawn out after being accommodated in the guide, when the second angle is secured at a time the rod-shaped body is accommodated at the accommodation position, a user only needs to push the large diameter portion in the axial direction of the guide to rotate the large diameter portion and the rod-shaped body about the axis, whereby the rod-shaped body and the large diameter portion are easily accommodated at the accommodation position. The encasing surface may be formed as a portion of the housing and may be formed by a member independent from the housing.

When the shape of the large diameter portion is small, although it is difficult to pick the large diameter portion to apply drawing force to the rod-shaped body at the accommodation position, since it is easy to apply rotating force to the large diameter portion, the large diameter portion can be formed in a small shape. In addition, when a handle for rotation operation is formed in the large diameter portion, it becomes easier to rotate the large diameter portion about the axis of the rod-shaped body. In particular, when the large diameter portion provided with the handle is applied to a portable or mobile type apparatus, a user can perform a holding operation of the apparatus body and a drawing operation of the rod-shaped body with one hand of the user. The whole rod-shaped body except the large diameter portion may be accommodated in a hole formed in the housing and may be accommodated in a groove formed in the surface of the housing so that a portion of the rod-shaped body is exposed to the outside.

The relationship between the rotation amount of the large diameter portion and the sliding amount of the rod-shaped body depends on the first and second angles. When the efficiency of the cam effect is improved so that a large sliding amount can be obtained by a small rotation amount, the operability can be improved in that respect. However, when the first and second angles are decreased to improve the efficiency of the cam effect, a large force is required to rotate the large diameter portion and thus the operability decreases in that respect. When the first and second angles are selected such that when the large diameter portion is rotated in the range of ¼ rotation to ½ rotation, a gap of a maximum of 5 mm to 15 mm is formed between the encasing surface and the large diameter portion, it is possible to provide an operability that is harmonized from the two respects.

In accordance with another aspect of the present invention, there is provided an apparatus provided with a housing thereof for housing a rod-shaped body. The rod-shaped body may be a rod-shaped antenna connected to a wireless module. The rod-shaped antenna may be a unipole antenna, a rod antenna, or a whip antenna, for example. In addition, the rod-shaped body may be a stylus pen for performing input operations to a display of an information apparatus.

The discussion will now turn to the drawings. Referring now to FIG. 1, a perspective diagram illustrating the external view of a note PC 10 according to an embodiment of the present invention is shown. The note PC 10 includes a main housing 11 on which a keyboard and a pointing device is mounted and in which many devices are accommodated, and a display side housing 13 on which a liquid crystal display (LCD) 15 is mounted. The display side housing 13 is openably and closably attached to the main housing 11. In the display side housing 13, a rod antenna 100 used for wireless data communication is accommodated in a top 17 which is disposed at the top in a state where a users opens to use the note PC 10. The display side housing 13 is formed by attaching components such as the LCD 15 and the antenna 100 to a metal frame that makes up a skeleton and thereafter attaching an exterior part made of a rigid plastic thereto. According to the drawer structure of the present invention, it is not necessary to use metal components around the antenna 100, which may have bad influence on communication performance, except components necessary for connection with a high-frequency circuit.

The top 17 of the display side housing 13 is not at right angle to the front and rear surfaces of the display side housing 13 but is constructed as a slope surface having an inclination of about 30 degrees with respect to a surface perpendicular to the front and rear surfaces. Although this slope surface is provided in consideration of the external appearance or based on the easiness to open/close the display side housing 13, in the present embodiment, the slope surface constitutes a portion of the drawer structure. The rod antenna 100 is a wireless WAN antenna. The display side housing 13 incorporates therein a wireless LAN antenna (not shown) independent from the rod antenna 100.

Figure 2:
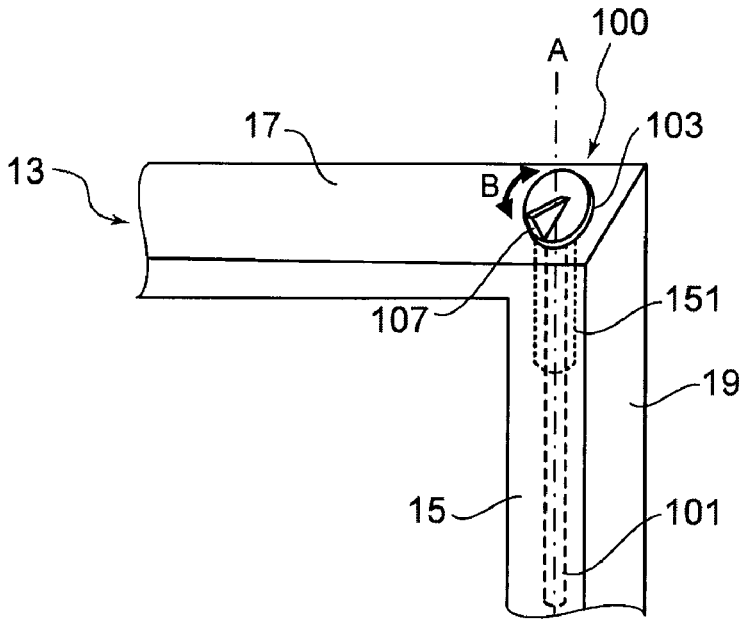
FIG. 2 is an enlarged perspective view around an antenna portion in FIG. 1.
Figure 3A:
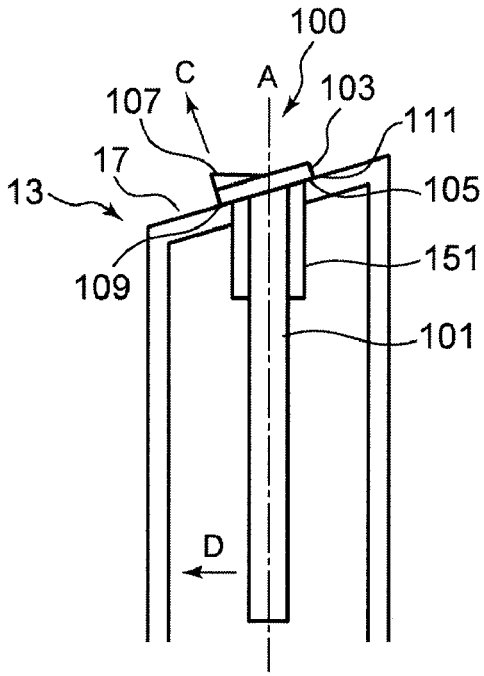
FIGS. 3A and 3B are cross sectional views of the antenna, illustrating a cross section taken from a direction of a side including an axis A of FIG. 2.
Figure 3B:
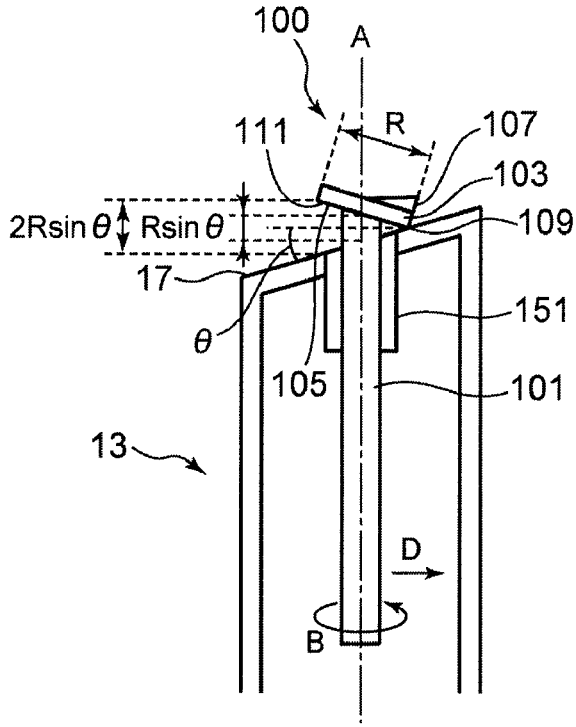

FIG. 2 is an enlarged perspective view around the antenna portion 100 in FIG. 1; and FIGS. 3A and 3B are cross sectional views illustrating a cross section taken from a direction of a side 19 including an axis A of the rod antenna 100 in FIG. 2. The rod antenna 100 includes a rod 101 and a guide cylinder 151. The rod 101 and the guide cylinder 151 have a cylindrical shape about the axis A. The guide cylinder 151 is fixed at the display side housing 13. The rod 101 is held at the guide cylinder 151 so that it can rotate in a direction B about the axis A and slid in the direction of the axis A. The guide cylinder 151 functions as a guide for allowing the rod 101 to be slid in the direction of the axis A. Although the direction of the axis A is substantially parallel to the front surface, the side 19, and the rear surface of the display side housing 13, the present invention is not limited to this since the rod 101 only needs to be accommodated in the display side housing 13. Moreover, the guide cylinder 151 is in electrical contact with the rod 101, and therefore, electrical connection between the rod 101 and a wireless WAN module (not shown) incorporated in the main housing 11 can be ensured. A large diameter portion or a cap 103 is fixed at an upper tip of the rod 101.

The cap 103 has a circular plate shape, and the circular plate is fixed at the cap 103 so that the center of the circular plate passes through the axis A. FIG. 2 shows the state where the rod antenna 100 is completely accommodated in the display side housing 13. Hereinafter, the position of the rod antenna 100 in this state will be referred to as an accommodation position. The cap 103 is formed such that an internal surface disposed at the lower side of the circular plate and the external surface disposed at the upper side of the circular plate are parallel to the top 17 when the rod antenna is at the accommodation position, and the internal surface is fixed at the tip of the rod 101 so as to be inclined with respect to the axis A. When the rod antenna 100 is at the accommodation position, the entire internal surface of the cap 103 makes contact with the top 17. Hereinafter, the internal surface of the cap 103 will be referred to as a contact surface 105.

A handle 107 is formed at the external surface of the cap 103. The handle 107 is projected upward from the external surface so that a user can catch the handle at the user's fingertips when the cap 103 and the rod 101 are integrally rotated. The user can catch the handle 107 at the fingertips to rotate the cap 103 in the arrow B direction about the axis A.

In the state of FIGS. 2 and 3A, the handle 107 is formed to extend following the descending slope surface of the top 17. By forming the handle 107 so as to extend in the descending direction, it is easy to identify the accommodation position with the eyes and it is thus convenient. However, the position of the handle 107 is not limited to such a position. A contact portion 109 is defined at a portion of the contact surface 105. The contact portion 109 is disposed at a position of the contact surface 105 corresponding to the lowest slope position of the top 17 in the accommodation position shown in FIG. 3A.

Next, an operation of rotating the cap 103 to draw out the rod antenna 100 at the accommodation position will be described. Now, it is assumed that the user catches the handle 107 at the fingertips to rotate the cap 103 by 180 degrees about the axis A. The direction B may be a right-handed rotation or a left-handed rotation. Since the rod 101 can be rotated by 180 degrees while the contact surface 105 of the cap 103 makes contact with the top 17, the rod 101 needs to be moved in a direction inclined with respect to the axis A in accordance with the rotation. However, since the rod 101 is held and surrounded by the guide cylinder 151, the rod 101 can only perform a rotational movement about the axis A and a translatory movement in the direction of the axis A.

Therefore, when the contact portion 109 is rotated about the axis A, the contact portion 109 is moved in a rotating manner in an ascending direction of the inclined top 17 while making contact with the top 17. Therefore, the contact portion 109 receives a force acting in the arrow C direction in which it is raised upward from the top 17. The force in the arrow C direction contributes to a rotation moment that inclines the rod 101 in the arrow D direction with respect to the axis A. However, since the guide cylinder 151 applies a repulsive force to the rotation moment in the arrow D direction, the rod 101 is slid in the direction of the axis A. Therefore, the rod 101 is moved in a direction where it is drawn out from the guide cylinder 151 in accordance with the rotation of the cap 103. When the cap 103 is rotated by 180 degrees about the axis A, the contact portion 109 is still in contact with the top 17 while a drawn-out portion 111 defined at a position of the contact surface 105 symmetrical to the contact portion 109 relative to the axis A is disposed at the state shown in FIG. 3B with a gap between the drawn-out portion 111 and the top 17.

In such a state shown in FIG. 3B, an angle between the top 17 and a plane vertical to the shaft A is defined as θ, and the diameter of the cap 103 is defined as R. An angle between the cap 103 and the plane vertical to the axis A is also θ. When the cap 103 is rotated by 180 degrees about the axis A, the rod 101 is drawn out by a distance of $R\sin\theta$ in the direction of the axis A. Meanwhile, the distance between the drawn-out portion 111 and the top 17 is $2R\sin\theta$ as measured in a direction from the drawn-out portion 111 toward a position corresponding to the lowest position of the inclined top 17.

For example, assuming that R is 1.0 cm and θ is 30 degrees, the rod 101 is drawn out by a distance of $R\sin\theta$ (=0.5 cm), while the distance between the drawn-out portion 111 and the top 17 is $2R\sin\theta$ (=1.0 cm). That is, a gap twice the drawn-out distance of the rod 101 from the guide cylinder 151 is formed between the top 105 and the drawn-out portion 111. Therefore, the user can draw out the rod 101 by inserting the user's finger between the drawn-out portion 111 and the top 17 in an easier manner than directly picking the handle 107. Though there is personal difference depending on the size of the user's finger, a distance of about 5 mm between the drawn-out portion 111 and the top 17 is sufficient for the user to draw out the antenna rod 101.

The greater the angle θ, the greater sliding amount of the rod 101 can be obtained at the same rotation amount. However, the greater the angle θ, the greater the frictional force between the contact portion 105 and the top 17 and the frictional force between the rod 101 and the guide cylinder 151, and as a result, a greater force is required for rotating the cap 103. For this reason, the angle θ is preferably set within a range in which a sliding amount of the tip of the rod 101 necessary for the drawing out can be provided by the rotation movement of the cap 103 within ½ rotation, and in which a smooth rotation movement of the cap 103 can be performed against the frictional force. More specifically, the angle θ is preferably set within the range of 10 degrees to 50 degrees. The range of the angle θ corresponds to the range of 40 degrees to 80 degrees when the angle is measured relative to the axis A.

Alternatively, it is preferable that when the cap 103 is rotated within the range of ¼ rotation to ½ rotation, the tip of the rod 101 is drawn out by a distance of about 5 mm to about 15 mm. When the cap 103 is rotated by ½ rotation, the drawn-out amount of the tip can be increased; however, a rotation of less than ½ rotation is also usable as long as it can provide a drawn-out amount at which the user can pick out the tip of the rod 101.

When the user accommodates the rod 101, the user only needs to press down the external surface of the cap 103 corresponding to the drawn-out portion 111 from the above. At this time, by an action opposite to that when the rod 101 is drawn out, the pressing force from the above is converted into a movement that rotates the cap 103 so that the contact portion 109 of the cap 103 is rotated from the highest slope position of the top 17 to the lowest slope position. Accordingly, the rod 101 is pushed deepest into the guide cylinder 151 and returns to the accommodation position. As is obvious from the above description, according to the present embodiment, the drawer structure of the rod antenna 100 is composed only of the contact portion 109 of the cap 103, the top 17, and the guide cylinder 151, and any other special components are not present. Therefore, it is only necessary to provide a space inside the display side housing 13 so that the rod 101 and the guide cylinder 151 can be accommodated in the space. In addition, it is not necessary to use metal components in the vicinity of the rod 101 and the guide cylinder 151, excluding components required for the electrical connection with the high-frequency circuit.

A portion of the top 17 that the contact portion 109 makes contact when the cap 103 is rotated from the accommodation position corresponds to the encasing surface of the present invention.

In FIG. 3, the contact surface 105 at the accommodation position makes contact with the entire top 17. However, in the present invention, the contact surface 105 at the accommodation position may not make contact with the entire top 17 but a gap may be present between the contact portion 109 and the top 17. Even in such a case, as long as the drawn-out portion 111 makes contact with the top 17 at the accommodation position, the contact portion 109 may make contact with the top 17 to receive a force in the arrow C direction before the cap is rotated by 180 degrees, whereby the rod 101 is slid.

Figure 4A:
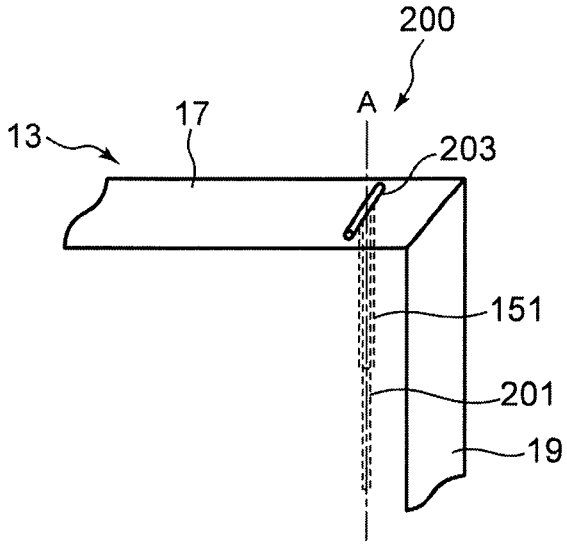
FIGS. 4A to 4C are diagrams for explaining another embodiment of the present invention.
Figure 4B:
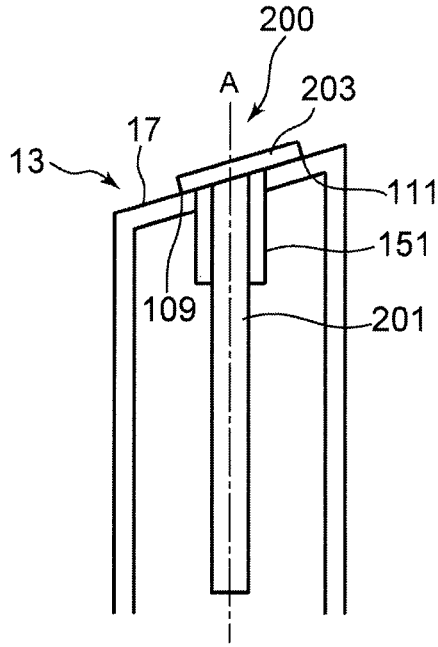
Figure 4C:
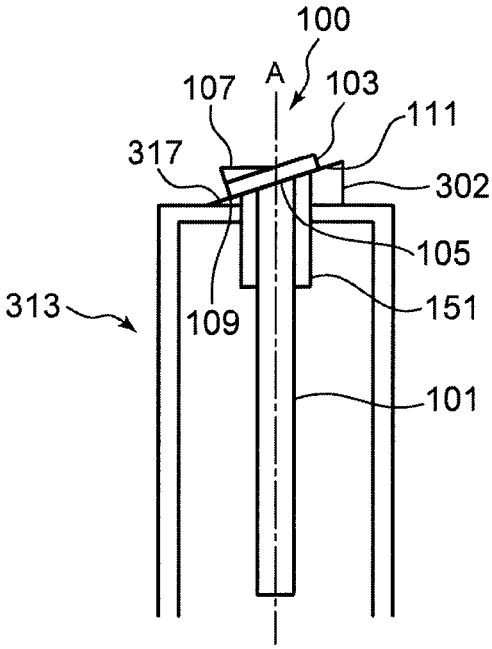

FIGS. 4A to 4C are diagrams for explaining another embodiment of the present invention. In this embodiment, the same components as the embodiment described with reference to FIGS. 1 to 3 will be referenced by the same reference numerals, and thus redundant description thereof will be omitted. Specifically, FIG. 4A is a perspective view illustrating the external view around an antenna 200 having a rod 201; and FIG. 4B is a cross sectional view illustrating a cross section taken from a direction of a side 19 including an axis A of the rod 201 in FIG. 4A. The cap 203 is not a circular plate but a cylindrical column and is fixed at the tip of the rod 201 at an angle the same as the angle of the top 17 relative to the axis A.

The cap 203 includes a contact portion 109 that makes contact with the top 17 and a drawn-out portion 111 that is disposed at a position symmetrical to the contact portion 109 about the axis A. Since the cylindrical column-shaped cap 203 itself functions as the handle at which the user's fingertip is caught, it is not necessary to provide the handle 107 shown in FIG. 2. As long as a rotation area of the cap 203 can be provided on the top 17, a distance between the drawn-out portion 111 and the axis A may be set larger than the distance between the contact portion 109 and the axis A. When the distance between the drawn-out portion 111 and the axis A is set large, though the distance the drawn-out portion 111 is moved by the rotation movement becomes large, the cap 203 can be moved with a small force by the principle of leverage.

The present invention can be embodied by using the slope of an exterior surface of a device housing. However, a slope that can be used in the present invention may not be present in the exterior surface of a device housing 313. In such a case, for example, as shown in FIG. 4C, the guide cylinder 151 may be attached to the housing 313 via a slope member 302. FIG. 4C is a cross sectional view illustrating a cross section taken from a direction of a side 19 including an axis A of the rod antenna 100 attached to the device housing 313. The slope member 302 provides an inclined top 317 around the rod antenna 100. The present invention can be embodied by using the slope member 302 even when it is difficult to form a slope surface in the housing.

The present invention can be applied regardless of characteristics such as a frequency band of an antenna as long as the antenna is a rod-shaped antenna which can be freely drawn out and accommodated. Therefore, the drawer structure according to the present invention can be applied to the case where a rod-shaped antenna is accommodated not only in the note PC as illustrated in the above-described embodiments but also in a cellular phone, a transceiver, an information terminal, a television receiver, and a radio receiver.

In addition, the present invention is not limited to the antenna but can be widely applicable to a device having a structure in which a rod-shaped body is accommodated in a housing. Moreover, it does not matter whether the rod-shaped body is removable from the device body and whether the rod-shaped body is an accessory of the device. A stylus pen used for touch panel input is a typical example of the rod-shaped body. In this case, the cross section of the rod-shaped body is not limited to a cylindrical shape as long as it is rotatably and slidably inserted in the housing. Moreover, the rod-shaped body may be accommodated inside the device housing and may be accommodated in a groove formed in the surface of the housing so that a portion thereof is exposed to the outside.

If not otherwise stated herein, it is to be assumed that all patents, patent applications, patent publications and other publications (including web-based publications) mentioned and cited herein are hereby fully incorporated by reference herein as if set forth in their entirety herein.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention.

What is claimed is:

1. An apparatus comprising:

a drawer structure for drawing a rod-shaped body out of a housing, the rod-shaped body having a large diameter portion at a tip thereof and being provided with an axis extending in a longitudinal direction, the drawer structure comprising:

a guide for holding the rod-shaped body so that the rod-shaped body can be rotated about the axis and slid in the direction of the axis, the guide being formed in the housing;

an encasing surface which crosses at a first angle to the axis when the rod-shaped body is inserted into the guide, the encasing surface being formed around an insertion slot of the guide; and a contact portion which receives force from the encasing surface when the rod-shaped body rotates about the axis, the contact portion being formed in the large diameter portion and being coupled with the rod-shaped body at a second angle to the axis.

2. The apparatus according to claim 1, wherein the large diameter portion includes an internal surface facing to the encasing surface, the contact portion forms a portion of the internal surface, the encasing surface and the internal surface are flat surfaces, and the first angle and the second angle are identical to each other.

3. The apparatus according to claim 2, wherein the first angle and the second angle are in the range of 40 degrees to 80 degrees.

4. The apparatus according to claim 3, wherein the guide is formed inside the housing, and the encasing surface forms a portion of the housing.

5. The apparatus according to claim 4, wherein a handle for rotation operation is formed in the large diameter portion.

6. The apparatus according to claim 2, wherein the guide is formed inside the housing, and the encasing surface forms a portion of the housing.

7. The apparatus according to claim 6, wherein a handle for rotation operation is formed in the large diameter portion.

8. The apparatus according to claim 1, wherein the guide is formed inside the housing, and the encasing surface forms a portion of the housing.

9. The apparatus according to claim 8, wherein a handle for rotation operation is formed in the large diameter portion.

10. The apparatus according to claim 1, wherein a handle for rotation operation is formed in the large diameter portion.

11. The apparatus according to claim 1, further comprising a processor.

12. An apparatus comprising:

a drawer structure for drawing a rod-shaped body having, at a tip thereof, a large diameter portion out of a housing provided with a guide, wherein an encasing surface is formed around an insertion slot of the guide while forming a first angle to a drawing direction of the rod-shaped body;

a contact portion is defined to the large diameter portion, the contact portion being coupled with the rod-shaped body at a second angle to the drawing direction, and the contact portion receiving force from the encasing surface when the large diameter portion of the rod-shaped body inserted into the guide is rotated; and a portion of the rod-shaped body further receives force from the guide so that the rod-shaped body slides in the drawing direction.

13. The apparatus according to claim 12, wherein when the large diameter portion is rotated in the range of ¼ rotation to ½ rotation in a state where the rod-shaped body is inserted into the guide, a space in the rage of at least 5 mm to 15 mm is formed between the encasing surface and the large diameter portion.

14. The apparatus according to claim 12, further comprising a processor.

15. An apparatus comprising:

a housing;

a rod-shaped body which has a large diameter portion at a tip thereof, and is provided with an axis extending in a longitudinal direction;

a guide for holding the rod-shaped body so that the rod-shaped body can be rotated about the axis and slid in the direction of the axis, the guide being formed in the housing;

an encasing surface which crosses at a first angle to the axis when the rod-shaped body is inserted into the guide, the encasing surface being formed around an insertion slot of the guide; and a contact portion which receives force from the encasing surface when the rod-shaped body rotates about the axis, the contact portion being formed in the large diameter portion and being coupled with the rod-shaped body at a second angle to the axis.

16. The apparatus according to claim 15, wherein the apparatus includes a wireless module, and the rod-shaped body is a rod antenna which is connected to the wireless module.

17. The apparatus according to claim 15, wherein the apparatus includes a display, and the rod-shaped body is a stylus pen for inputting data to the display.

18. The apparatus according to claim 15, further comprising a processor.

* * * * *